United States Patent [19]

Ripka

[11] 4,231,417

[45] Nov. 4, 1980

[54] METHOD AND APPARATUS FOR REDUCING CORROSION IN A HEAT EXCHANGER

[75] Inventor: Chester D. Ripka, East Syracuse, N.Y.

[73] Assignee: Carrier Corporation, Syracuse, N.Y.

[21] Appl. No.: 44,449

[22] Filed: Jun. 1, 1979

[51] Int. Cl.[3] ..... F28F 19/00

[52] U.S. Cl. ..... 165/3; 165/134 DP

[58] Field of Search ..... 165/134 DP, 134 R, 65, 165/2, 3

[56] References Cited

U.S. PATENT DOCUMENTS

| | | | |
|---|---|---|---|
| 2,363,870 | 11/1944 | Karlsson et al. | 165/134 DP |
| 2,468,826 | 5/1949 | Karlsson et al. | 165/134 DP |
| 2,665,840 | 1/1954 | Powell | 165/134 DP |
| 2,951,685 | 9/1960 | Bliss et al. | 165/134 DP |
| 2,970,811 | 2/1961 | Ruch et al. | 165/134 DP |
| 3,496,992 | 2/1970 | Leonard, Jr. | 165/2 |
| 3,667,451 | 6/1972 | Boucher | 126/110 R |

FOREIGN PATENT DOCUMENTS

| | | | |
|---|---|---|---|
| 707792 | 4/1954 | United Kingdom | 165/2 |

*Primary Examiner*—Sheldon Richter

*Attorney, Agent, or Firm*—J. Raymond Curtin; Donald F. Daley

[57] ABSTRACT

Method and apparatus for preventing condensate from forming on the inside walls of the heat exchanger of a combination air conditioning and heating unit during the cooling mode of operation. The formation of condensate on the inside surfaces of the heat exchanger is reduced by bleeding a small but sufficient amount of air pressurized by the air blower and conditioned by the evaporator into the combustion chamber and then into the heat exchanger to displace ambient air with high moisture content from the interior of the heat exchanger. A hole or a number of holes is provided in the partition separating the discharge section from the burner control section which is open to atmosphere to allow a portion of conditioned air into the heat exchanger.

5 Claims, 1 Drawing Figure

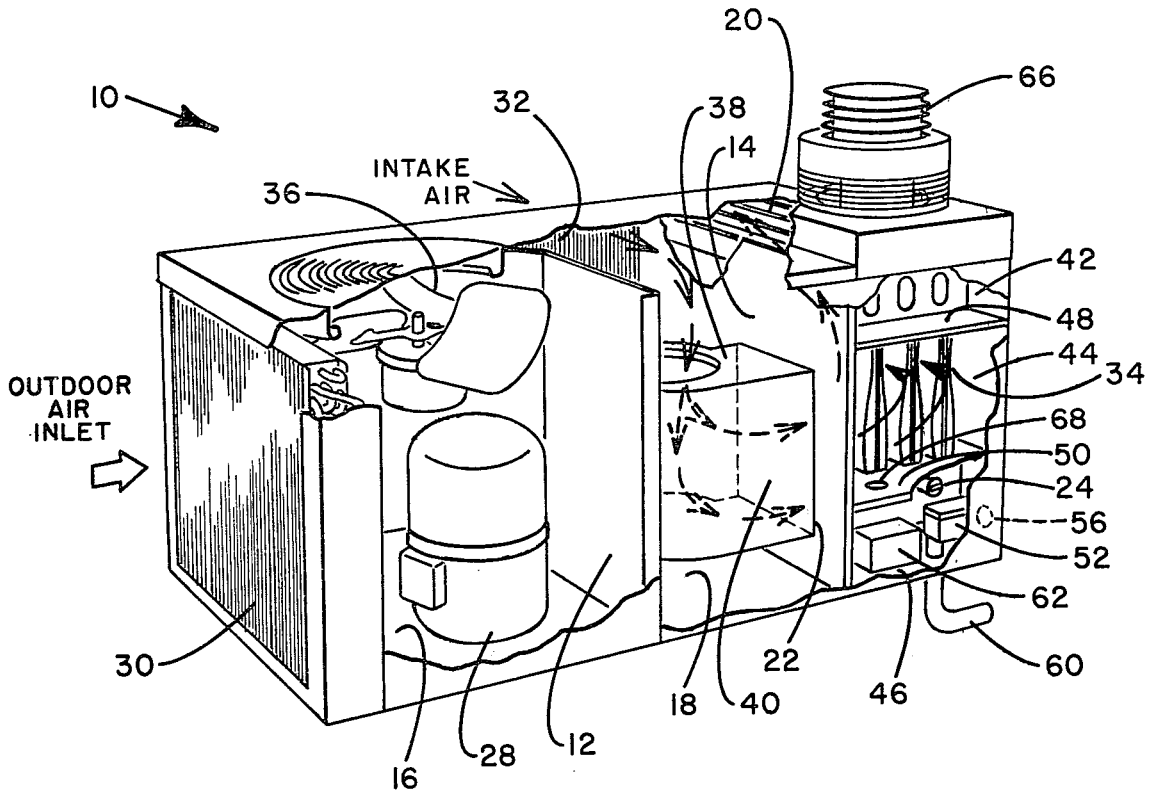
10
INTAKE AIR
OUTDOOR AIR INLET
20
66
32
38
14
36
42
48
44
34
68
50
24
56
52
62
60
30
22
46
18
40
16
28
12

METHOD AND APPARATUS FOR REDUCING CORROSION IN A HEAT EXCHANGER

BACKGROUND OF THE INVENTION

1. Field of the Invention

This invention relates to a combination air conditioning and heating unit and more particularly to a method and apparatus for minimizing corrosion of heat exchangers by substantially reducing the formation of condensate on the heat exchanger during the cooling season.

2. Description of the Prior Art

Conventional combination air conditioning and heating units include burners which mix a supply of gas and air in the Venturi section of the burner and direct this mixture into the combustion chamber where it is typically open to the atmosphere to provide ambient air for a combustible mixture. The mixture is ignited and combustion takes place in the combustion chamber. In such conventional arrangements the burner is located beneath the heat exchanger and the combustion products rise upwardly through the heat exchanger and are discharged to the atmosphere. The heat exchanger is formed to accommodate the flow of the gas from the combustion chamber into contact with one side of the surfaces of the heat exchanger. The apparatus of the foregoing type also includes a fan assembly for directing air over the opposite side of the surface of the heat exchanger. Heat generated by the combustion products is transferred through the heat exchanger surfaces, which are usually metal, to the air circulated over the heat exchanger surface by the fan.

The apparatus also comprises a compressor, a condenser and an evaporator connected into a closed circuit to provide air conditioning during periods when the burner is not operating.

During the cooling season when the heat exchanger is not operable, a relatively warm ambient air passes from the combustion chamber which is open to atmosphere, through the interior of the heat exchanger. When the evaporator is operable, for air conditioning purposes, the chilled air which has passed over the evaporator or the returned air from the building is brought into contact with the outside surface of the heat exchanger. As a consequence of cooling the tubes of the heat exchanger by the passage of cooled air from the evaporator, or from the building, the temperatures of the inside surfaces of the heat exchanger may be so low as to be below the dew point of the ambient air passing within the tubes of the heat exchanger. Under such conditions, moisture from the ambient air passing through the heat exchanger will be condensed on the inside walls resulting in the corrosion of the heat exchanger casing.

SUMMARY OF THE INVENTION

It is an object of the present invention to provide an improved combination air conditioning and heating unit.

Another object of the present invention is to prevent or substantially reduce the formation of condensate on the inside surfaces of a heat exchanger during the cooling season, in a combination heating and cooling unit.

These and other objects are attained by introducing small amounts of pressurized evaporator air or cooled returned air into the combustion chamber and transferring this air through the heat exchanger as to displace ambient air with high moisture content from the heat exchanger thereby keeping moisture from condensing on the inside walls of the heat exchanger.

BRIEF DESCRIPTION OF THE DRAWINGS

In the drawing FIGURE is an isometric view of the combination air conditioning and heating unit embodying the present invention, with portions of side walls broken away, illustrating the internal components thereof and the circulation of air through the unit.

DESCRIPTION OF THE PREFERRED EMBODIMENT

Referring to the Figure, the combination air conditioning and heating unit generally designated by 10 includes a cabinet subdivided by vertical partitions 12 and 14 into three compartments 16, 18 and 20. The embodiment of the invention shown relates to the application where the evaporator coil is located upstream of the heat exchanger. The unit includes a compressor 28 and a condenser 30 connected to an evaporator 32 in the conventional manner to provide refrigerant fluid to the evaporator. For this particular application air passing over the evaporator is cooled and then fed as supply air to an area to be cooled. In this case the cooled supply air passes over a heat exchanger 34 which is used during cool weather to heat the supply air.

Condenser 30 and compressor 28 are disposed in compartment 16 in which an upflow condenser fan 36 is mounted for circulation air over the condenser. The evaporator 32 and a supply air blower 38 are mounted in a plenum compartment 18. Blower 38 has a discharge outlet 22 which is connected to a heat exchanger compartment 20 by an opening 40 formed in partition 14. Compartment 20 is further partitioned into three sections: an upper section or a flue collector box 42, a middle air discharge heat exchanger section 44, and a lower burner-controls section 46 by horizontally extended partitions 48 and 50. Section 44 accommodates the heat exchanger 34 in the path of air discharged by the blower 38 through opening 40.

Heat exchanger 34 is formed of conventional tubes, the inside surfaces of which are heated by hot flue gases passing through the inside or gas side of the heat exchanger. The heat is imparted to an air stream circulated by the blower 38 through the opening 40, into a discharge heat exchanger section 44, over the outside surfaces of the heat exchanger and then to the space to be heated. This air stream is indicated in the FIGURE as supply air. The heat exchanger tubes are usually of steel or other metal which readily conducts heat.

A gas-fired burner 24, (only partially shown) utilizing a gaseous mixture as fuel is located partially in the heat exchanger 34 and partially in the burner-controls section 46 of compartment 20. The burner-controls section 46 and heat exchanger 34 are open to the atmosphere through combustion air intake holes 56 in the side panel of the unit. Fuel is provided to the burner 24 through a gas valve 52 and a supply line 60 connected to a source of pressurized fuel gas (not shown). Ingition means 62 are provided to ignite the combustible fuel in the burner. The ignited mixture of fuel gas and air produces, in the burner, a high heat source which is discharged inside the heat exchanger 34. The combustion products rise upwardly through the tubes of heat exchangers 34 and are discharged to the flue collector section 42, then to the atmosphere through a vent means 66.

During the cooling cycle, when the burner 50 is turned off and condenser 30 and evaporator 32 are operating in a cooling mode of operation, the air passing over the evaporator tubes will be chilled. The arrows shown in the FIGURE illustrate a direction of the air flow. In this application intake air entering the compartment 18 is chilled by evaporator 32 and is directed by blower 38 through opening 40 over the heat exchanger, thereby cooling the outside walls of the heat exchanger. The heat exchanger, which is in communication with the burner controls section 46, contains the ambient air from the atmosphere at relatively high temperature and at high humidity. The chilled air flowing over the outside surfaces of the heat exchanger decreases the temperature of the walls of the heat exchanger. When the temperature of the heat exchanger surface is at or below the dew point of the ambient air entering the heat exchanger, moisture will be condensed from the ambient air onto the inside surfaces of the heat exchanger and ultimately causes corrosion of these surfaces. To prevent or substantially reduce the formation of condensate on the inside walls of the heat exchanger, a relatively small but sufficient amount of conditioned air is provided to the burner-controls section 46 and ultimately to the interior of the heat exchanger 34. A hole, or a number of holes 68, is provided in partition 50 to pass the discharge air from the blower 38 to the burner-controls section 46. The cooled air which has passed over evaporator 32 and is pressurized by blower 38, enters chamber 44 and then burner-controls section 46 through opening 68.

In operation, chilled evaporator air in compartment 18, pressurized by air blower 38, flows through opening 40 to pass over the heat exchanger. At the same time a small amount of chilled air is forced through hole 68, into the burner-controls section 46, and into the heat exchanger 34 under pressure provided by air blower 38. Small amounts of chilled air may spill out of burner-controls section 46 through combustion air intake holes 56. Cool evaporator air entering the heat exchanger at a pressure relatively higher than the ambient air pressure flows upwardly from the burner-controls compartment into the heat exchanger and displaces the ambient air in the heat exchanger. Cooled evaporator air passing through the internal passageways of the heat exchanger has a low dew point and thereby eliminates the condition whereby condensation can collect on the walls of the heat exchanger.

The walls of the collector box 42 are also subjected to corrosion during the cooling season. Cooled air leaving the interior of the heat exchanger passes through the collector box 42 also displacing the high moisture content ambient air from the collector box. This prevents or substantially reduces the formation of condensate on the inside surfaces of the heat exchanger.

It should be noted that the evaporator coil may be located downstream from the heat exchanger as is also customary in the industry. The operation of the above-described invention is also applicable for this location of the evaporator coil. In the application where the evaporator is located downstream from the heat exchanger, the return air from the building is forced into the heat exchanger to displace the high moisture content ambient air from the heat exchanger. Return air from the building is normally at a temperature lower than outside ambient air and is of lower moisture content thus preventing or reducing the condensate formation.

In the instances where combustion air conditioning and heating units are provided with a combustion air blower that is located either in the burner-controls section for pressurizing combustion air or at the outlet of the heat exchanger for inducing combustion air during the heating mode of operation, this combustion air blower is turned off during the cooling season.

While the present invention has been described in connection with the particular embodiment, it is to be understood to those skilled in the art that various modifications may be made without departing from the scope of the appended claims.

I claim:

1. In combination heating and air conditioning equipment wherein air is passed over a cooling coil during a cooling cycle, creating conditioned air, and during a heating cycle, air is passed over a heat exchanger of the type having walls forming an interior chamber which contain hot gasses during the heating cycle and ambient air during the cooling cycle, the method of reducing corrosion within the heat exchanger during the cooling cycle comprising: Separating a portion of the conditioned air, and forcing the separated portion of the conditioned air into the interior chamber of the heat exchanger to displace high moisture content ambient air, thereby reducing or eliminating condensation formation on the walls of the heat exchanger.

2. In combination heating and air conditioning equipment of the type wherein a heat exchanger for transferring heat from a hot gas passing through the heat exchanger to a cool gas such as air flowing over the heat exchanger during the heating mode of operation is located in the flow path of cooled air from the air conditioning equipment during the cooling mode of operation and has interior surfaces open to the atmosphere during the cooling mode of operation, the method of reducing corrosion within the heat exchanger comprising:

conditioning a supply of air by reducing the temperature of the air by passing the air through the evaporator of the air conditioning portion of the heating and air conditioning equipment, and passing the conditioned air over the exterior surfaces of the heat exchanger, separating a portion of the air from the main flow of conditioned air, and directing the separated portion of the conditioned air into the interior of the heat exchanger to displace high moisture content ambient air, thereby reducing condensate formation on the walls of the heat exchanger.

3. The method in accordance with claim 2, wherein the separated portion of the conditioned air is forced into the heat exchanger by the pressure developed in the supply of conditioned air in the air conditioning portion of the heating and air conditioning equipment.

4. A combination air conditioning and heating apparatus comprising:

a housing having vertically extending partitions dividing said housing to compartments including a plenum compartment and a heat exchanger compartment, said plenum compartment containing an evaporator and an air blower, said evaporator being connected in an air conditioning circuit to provide cooling, said heat exchanger compartment being partitioned into upper, middle and lower sections, said upper section comprising a flue collector box, said middle section containing a heat exchanger for heating air discharged from the plenum during the heating mode of operation, said air blower in the plenum compartment having a discharge outlet mounted to deliver air to said middle section of the heat exchanger compartment to flow over the heat exchanger, said lower section of the heat exchanger compartment containing a burner for burning a fuel gas-air mixture and being open to the atmosphere to provide flow of combustion products through the heat exchanger and then to atmosphere, means to supply cooled air from the discharge outlet of the air blower to the lower section of the heat exchanger compartment and the interior of the heat exchanger, thereby to displace ambient air from the interior of the heat exchanger and from the walls of said collector box and reduce or eliminate condensate formation on the walls of the heat exchanger and the collector box.

5. The combination air conditioning and heating apparatus in accordance with claim 4, wherein at least one opening is formed in the partition between the middle section and the lower section of said heat exchanger compartment, and said opening is located downstream of the blower discharge outlet to introduce a portion of the conditioned air into said lower section of the heat exchanger compartment.

* * * * *